United States Patent [19]

Schmidt

[11] 4,214,158

[45] Jul. 22, 1980

[54] DETERMINATION OF INFINITE DILUTION ACTIVITY COEFFICIENTS ($\gamma\infty$) USING MOLECULAR BEAMS

[75] Inventor: Thomas W. Schmidt, Bartlesville, Okla.

[73] Assignee: Phillips Petroleum Company, Bartlesville, Okla.

[21] Appl. No.: 7,737

[22] Filed: Jan. 30, 1979

[51] Int. Cl.[2] ..... B31D 59/44

[52] U.S. Cl. ..... 250/281; 250/251; 250/283; 250/288

[58] Field of Search ..... 250/281, 251, 283, 288

[56] References Cited

U.S. PATENT DOCUMENTS

| | | | |
|---|---|---|---|
| 3,924,123 | 12/1975 | Schmidt | 250/251 |
| 3,924,124 | 12/1975 | Favre et al. | 250/281 |
| 4,068,122 | 10/1975 | Schmidt et al. | 250/281 |

*Primary Examiner*—Harold A. Dixon

[57] ABSTRACT

Infinite dilution activity coefficients ($\gamma\infty$) are determined for a binary liquid system utilizing dual molecular beams. The vapors from two liquid systems, at least one of which is a binary liquid system, are collimated into molecular beams. The molecular beams are alternately chopped before being detected by mass spectrometer. The output from the mass spectrometer is representative of the difference in partial pressure for any component in the two liquid systems. The output from the mass spectrometer can be utilized to calculate $\gamma\infty$ for the binary liquid system.

4 Claims, 6 Drawing Figures

DETERMINATION OF INFINITE DILUTION ACTIVITY COEFFICIENTS ($\gamma\infty$) USING MOLECULAR BEAMS This invention relates to a method for measuring infinite dilution activity coefficients using molecular beams.

In the thermodynamic treatment of liquid solution behavior, deviations from ideality are taken into account by the incorporation of the activity coefficient ($\gamma$) as a correction factor. The deviation of $\gamma$ from unity is greatest for conditions of maximum deviation from ideal behavior. This occurs for a substance when it is infinitely dilute in another component. Hence, the infinite dilution activity coefficient ($\gamma\infty$) is a measure of the maximum nonideal behavior of a substance which is dissolved in another. It is well known that given accurate values for $\gamma\infty$, binary vapor-liquid equilibria can be well characterized over the entire concentration range. This binary vapor-liquid equilibria data can be utilized to calculate vapor liquid and liquid-liquid separation factors which must be known to design distillation or extraction systems.

The term infinitely dilute, as used herein, means that the solute is sufficiently dilute in the solvent that solute molecules rarely encounter one another but generally are surrounded by only solvent molecules. This generally occurs at solute concentrations in the range of about $10^{-3}$ to about $10^{-5}$ mole fraction.

Historically, $\gamma\infty$ values have been determined by extrapolating to zero concentration values of $\gamma$ determined at finite concentrations. The main problem with this method is that as zero concentration is approached, the value for $\gamma$ usually changes by ever increasing amounts. These rapid changes in $\gamma$ make accurate extrapolations nearly impossible.

More recently, a gas liquid chromatography technique has been developed to determine $\gamma\infty$ values. This technique is based on the observation that increased retention times are related to increased nonideal behavior. This method is limited by the relative volatilities of the components and the requirement that one of the components must be in the liquid phase in the chromatographic analyzer column.

It is thus an object of the present invention to overcome these difficulties with the prior art methods for determining $\gamma\infty$ by providing a method for measuring infinite dilution activity coefficients using molecular beams.

In accordance with the present invention, a method for measuring infinite dilution activity coefficients using molecular beams is provided wherein the vapors from each of two vapor-liquid equilibrium cells are collimated into molecular beams. The beams are alternately chopped before being detected by a mass spectrometer. The output signal from the mass spectrometer will be representative of the difference in partial pressure for any component in the two cells. Thus, with this arrangement, differences in pressure between a pure component and that containing a species at infinite dilution can be easily detected.

The molecular beam method for determining $\gamma\infty$ is a constant temperature technique where the change in pressure caused by composition change is measured. The equation relating $\gamma\infty$ to composition at constant temperature for liquid compositions is $$\gamma_1^\infty = \frac{\phi_2^s P_2^s\left[1-\left(\frac{V_2^L}{RT}+\frac{1}{\phi_2^s}\frac{d\phi_2}{dP}\right)\left(\frac{dP}{dx}\right)_T^\infty\right]+\left(\frac{dP}{dx_1}\right)_T^\infty}{\phi_1^s P_1^s \exp\left[\frac{V_1^L(P_2^s-P_2^s)}{RT}\right]} \quad (1)$$

for liquid compositions and $$\gamma_1^\infty = \frac{\phi_2^s P_2^s\left[\frac{1}{1+\frac{d\ln\phi_2}{dy_2}^\infty+\frac{1}{P_2^s}\left(\frac{dP}{dy_2}\right)_T^\infty}\right]}{\phi_1^s P_1^s \exp\left[V_1^L\frac{(P_2^s-P_1^s)}{RT}\right]} \quad (2)$$

for vapor compositions where $\gamma_1^\infty$ = the infinite dilution activity coefficient of component 1;

$\phi_1^s$ = the fugacity coefficient of component 1 at saturation;

$\phi_2^s$ = the fugacity coefficient of component 2 at saturation;

$P_1^s$ = the vapor pressure of component 1 at saturation;

$P_2^s$ = the vapor pressure of component 2 at saturation;

$V_1^L$ = the molar liquid volume of component 1;

$V_2^L$ = the molar liquid volume of component 2;

$\phi_1$ = the fugacity of component 1 at the pressure P;

$\phi_2$ = the fugacity coefficient of component 2 at pressure P;

$x_1$ = the mol fraction of component 1 in the liquid;

$Y_1$ = the mol fraction of component 1 in the vapor phase;

R = the gas constant; and

T = absolute temperature.

Assuming the gas phase to be an ideal solution and an ideal gas and assuming that the liquid volumes are small, equation (1) can be rewritten as $$\gamma_1^\infty = \frac{P_2^s+\left(\frac{dP}{dx_1}\right)^\infty}{P_1^s} \quad (3)$$

and equation (2) can be rewritten as $$\gamma_1^\infty = \frac{P_2^s}{P_1^s}\left[\frac{1}{1+\frac{1}{P_1^s}\left(\frac{dP}{dy_2}\right)}\right] \quad (4)$$

Equation (4) can be further simplified by letting the infinitesimals be approximated by finite differences so that $$dP = \Delta P_1 + \Delta P_2 \quad (5)$$

and $$dy_2 = \frac{P_2}{P_1+P_2} - 1 \quad (6)$$

Equation (5) can be rearranged to give $$dy_2 = \frac{-\Delta P_1}{P_2^s + \Delta P_1 + \Delta P_2} \quad (7)$$

since $P_1 = \Delta P_1$ and $P_2 = P_2^s + \Delta P_2$. Combining Equations (5) and (7) gives $$\frac{dP}{dy_2} = \frac{(\Delta P_1 + \Delta P_2)(P^s + \Delta P_1 + \Delta P_2)}{-\Delta P_1} \quad (8)$$

Assuming $P_1 + P_2 = P_2^s$ at infinite dilution equation (8) can be written $$\frac{dP}{dy_2} = -\frac{(\Delta P_1 + \Delta P_2) P_2^s}{\Delta P_1} \quad (9)$$

Substituting this into equation (4) and simplifying gives the relation $$\gamma_1^\infty = -\frac{P_2^s}{P_1^s}\left(\frac{\Delta P_1}{\Delta P_2}\right) \quad (10)$$

Thus, under the proper conditions, ideal solution gas, ideal gas and small $\Delta P$, the infinite dilution activity coefficient can be determined by measuring the changes in partial pressure of each component and knowing their vapor pressures. It is not necessary to know the exact composition of either the gas or liquid phases.

Either equation (3) or equation (10) can be utilized to calculate the infinite dilution activity coefficient. Equation (3) is preferred for solutions where $\gamma_\infty$ is greater than 2.0 and equation (10) is preferred for solutions in which $\gamma_\infty$ is less than 2.0.

When equation (3) is being utilized (pressure-concentration method), the output from the mass spectrometer will be representative of the term $dP\gamma$. Since the vapor pressure $P_1^s$ and $P_2^s$ are known, as well as the change in concentration $dx_1$, equation (3) can be utilized to calculate $\gamma_\infty$ based on the output from the mass spectrometer.

If equation (10) is utilized (partial pressure method) to calculate $\gamma_\infty$, then the output of the mass spectrometer will be representative of $\Delta P_1/\Delta P_2$. Again, $P_1^s$ and $P_2^s$ are known and equation (10) can be utilized to calculate $\gamma_\infty$ based on the output from the mass spectrometer. It is noted that when equation (10) is utilized to calculate $\gamma_\infty$, the amount of component (1) which was introduced into component (2), which is represented by $dx_1$ in equation (3), need not be known.

Other objects and advantages of the invention will be apparent from the foregoing description of the invention and from the claims, as well as from the detailed description of the drawings in which:

The invention is described in terms of a specific apparatus for introducing two molecular beams alternately into a mass spectrometer. However, the invention is applicable to any apparatus for introducing two molecular beams into a mass spectrometer alternately so long as the temperature of the two molecular beams may be held substantially constant.

Figure 1:
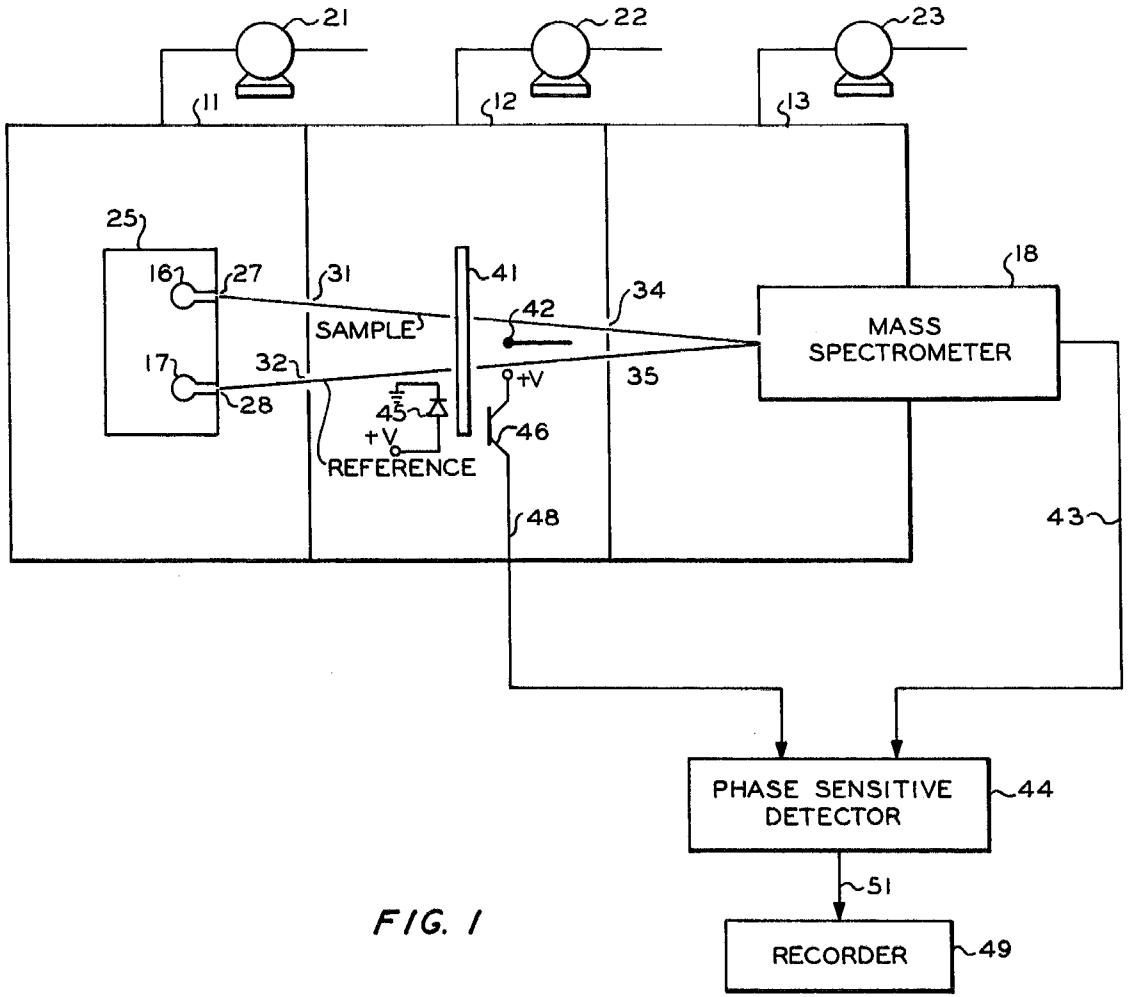
FIG. 1 is a simplified block diagram of a dual molecular beam system.

Referring now to FIG. 1, three chambers 11, 12 and 13 are illustrated. Chamber 11 contains the equilibrium cells 16 and 17. Chamber 12 contains the molecular beam forming system and the molecular beam chopping system. Chamber 13 contains the mass spectrometer 18. The mass spectrometer 18 is preferably a Model 270-9 quadrupole mass spectrometer equipped with an axial ionizer which is manufactured by Extranuclear Corporation, Pittsburgh, Pa.

The oil diffusion pump 21 is utilized to pull a vacuum in chamber 11. The vacuum in chamber 11 is preferably held at approximately $10^{-4}$ torr. The oil diffusion pump 22 is utilized to pull a vacuum in chamber 12. The vacuum in chamber 12 is preferably maintained at approximately $10^{-5}$ torr. The oil diffusion pump 23 is utilized to pull a vacuum in chamber 13. The vacuum in chamber 13 is preferably maintained at approximately $10^{-7}$ torr.

The equilibrium cells 16 and 17 are preferably small chambers in a copper block 25. The equilibrium cells 16 and 17 preferably hold a volume of approximately 6 cc. The vapors from the equilibrium cells 16 and 17 pass out of pinholes 27 and 28. The vapors are columnated into molecular beams by passing through apertures 31 and 32 in the wall between chambers 11 and 12 and also by passing through apertures 34 and 35 in the wall between chambers 13 and 12. The molecular beams originate approximately 12 millimeters apart at the equilibrium cells 16 and 17 and travel in substantially straight lines until the molecular beams converge at the mass spectrometer 18. The movement of the molecular beam from chamber 11 to chamber 13 is caused at least in part by the differential pressures at which chambers 11, 12 and 13 are held.

As has been previously stated, it is extremely important that the temperature of the two molecular beams be maintained equal. To accomplish this, the two equilibrium cells 16 and 17 are formed in a single copper block and a constant temperature liquid is circulated through the copper block 25 and around the equilibrium cells 16 and 17.

A chopping wheel 41 is utilized to block the molecular beams passing from the equilibrium cells 16 and 17 and pass the molecular beams alternately to the mass spectrometer 18. A beam balance filter 42 is also utilized to balance the intensity of the two molecular beams as measured at the mass spectrometer.

The output of the mass spectrometer 18 is provided as one input to the phase sensitive detector 44 which is preferably a Model 393 manufactured by Ithaca Corporation. The combination of the photodiode 45 and the phototransistor 46 is utilized to provide a reference signal to the phase sensitive detector 44. The output signal 48 corresponds to a series of pulses at a frequency corresponding to the frequency at which the molecular beams are alternately transmitted to the mass spectrometer. The output from the phase sensitive detector is provided to the recorder 49 which is preferably a Model 7132A dual channel recorder manufactured by Hewlett Packard.

The output signal 43 from the mass spectrometer 18 will be essentially a square wave. The phase sensitive detector 44 amplifies the portion of signal 43 which is in phase with the reference signal 48. The output signal from the phase sensitive detector 44 is thus essentially the integral of the amplified square wave output signal 43 from the mass spectrometer 18.

If the dual beam system, illustrated in FIG. 1, is being utilized to calculate $\gamma\infty$ utilizing equation (10) then a pure solution of component 2 is introduced into the equilibrium cells 16 and 17. $\Delta P_1$ will be zero because component 1 will not be present in the equilibrium cells 16 and 17. The beam balance filter 42 is utilized to balance the two molecular beams so that $\Delta P_2$ is zero. A very small amount (approximately $10^{-4}$ mol fraction) of component 1 is then added to the equilibrium chamber 16. $\Delta P_1$ and $\Delta P_2$ will both change from zero. When a measurement is made at the mass of component 1, the output signal 51 from the phase sensitive detector 44 will essentially be equal to $\Delta P_1$. When a measurement is made at the mass of component 2, the output signal 51 from the phase sensitive detector 44 will be essentially equal to $\Delta P_2$. The measured $\Delta P_1$ and $\Delta P_2$ can be utilized in calculating $\gamma_1\infty$ utilizing equation (10) because both $P_1^s$ and $P_2^s$ are known values.

If equation (3) is being utilized in the pressure-concentration method, then again a substantially pure solution of component 2 is introduced into the equilibrium cells 16 and 17. Again, the beam balance filter 42 is utilized to balance the two molecular beams. A small measured amount (approximately $10^{-4}$ mol fraction) of component 1 is then introduced into the equilibrium cell 16. The combination of the output signal 51 from the phase sensitive detector 44 when a measurement is made at the mass of component 1 and the output signal 51 from the phase sensitive detector 44 when a measurement is made at the mass of component 2 will be representative of the difference in the pressure of the two molecular beams after component 1 is introduced into the equilibrium cell 16. Thus, the combined output signals from the phase sensitive detector 44 are representative of the $dP\infty$ term of equation (3). Both $P_1^s$ and $P_2^s$ are known. $dx_1$ will be known because the amount of component 1 introduced into the equilibrium cell 16 will be known. Thus, the combined output signals from the phase sensitive detector 44 can be utilized to calculate $\gamma_1\infty$ utilizing equation (3).

Figure 2:
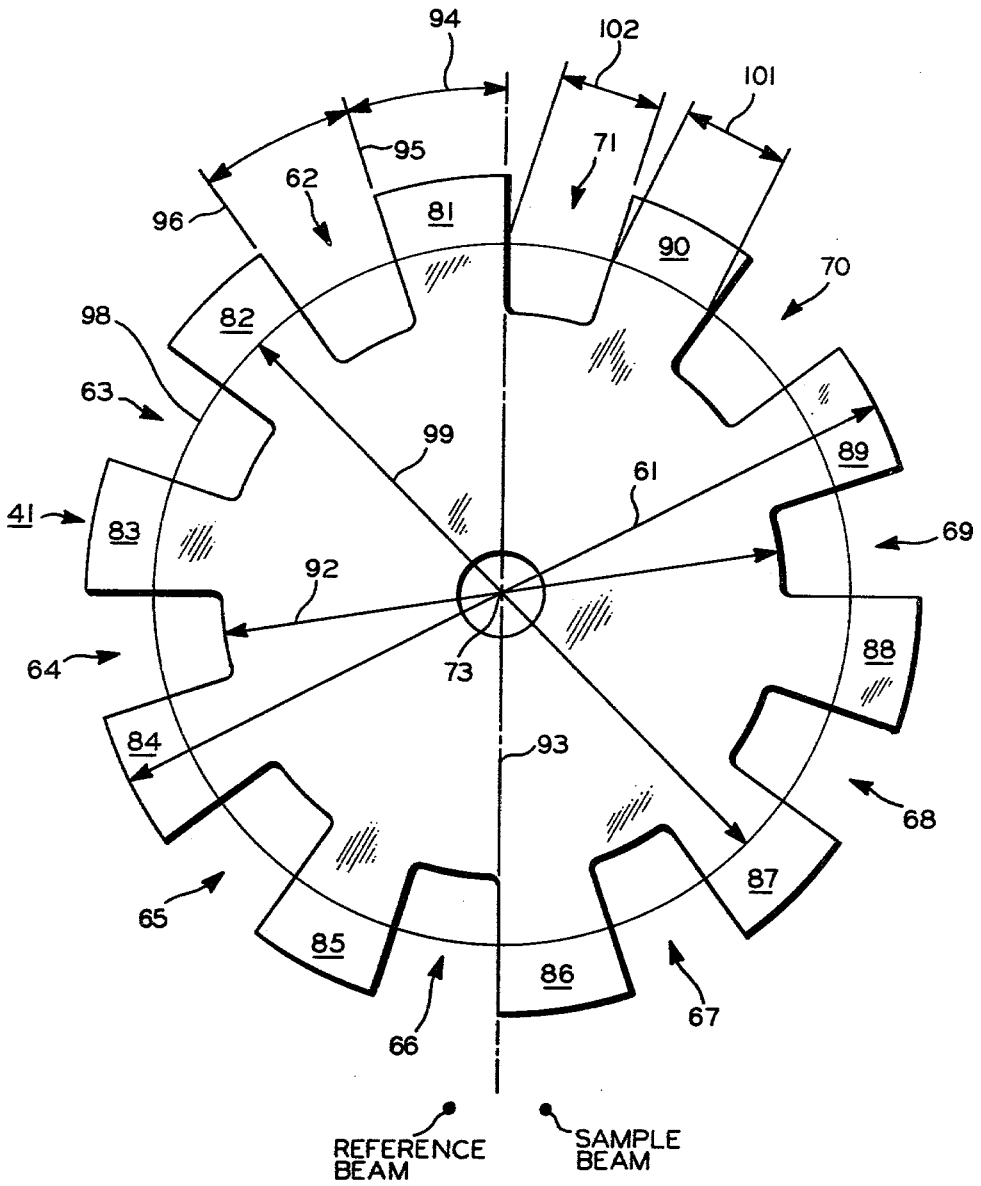
FIG. 2 is an illustration of the chopping wheel illustrated in FIG. 1.

The chopping wheel 41, which is illustrated in FIG. 1, is more fully illustrated in FIG. 2. Referring now to FIG. 2, the chopping wheel 41 is a circular disc having a preferred diameter 61 of 3.75 inches (9.525 cm). The chopping wheel 41 is characterized by a plurality of slots 62–71 along its outer periphery which are equally, angularly spaced with respect to the axis of rotation 73 of the chopping wheel 41. The slots 62–71 are open on one side along the periphery of the chopping wheel 41. The sides of the slots are equally, angularly spaced apart and lie along radii of the chopping wheel circle with the base of the slot 62–71 being segments of an inner circle. The bases of the slots 62–71 and the sides of the slots 62–71 are joined in a curved line having a radius of 0.0625 inches (1.587 mm). The slots 62–71 are separated by a plurality of teeth 81–90 which are also equally, angularly spaced with respect to the axis of rotation 73 of the chopping wheel 41. The sides of the teeth 81–90 are common to the sides of the slots 62–71 respectively. The outer edge of the teeth 81–90 forms the periphery of the chopping wheel 41. The inner circle common to the base of all these slots 62–71 has a preferred diameter 92 of 2.50 inches (6.35 cm).

As illustrated in FIG. 2, a reference line 93 through the axis of rotation 73 is common to the right edge, as viewed in FIG. 2, of the tooth 81. The reference line 93 is perpendicular to the axis of rotation 73 for the chopping wheel 41. The angle 94 formed by the reference line 93 and a line 95, which intersects the axis of rotation 73 and is common to the left edge, as viewed in FIG. 2, of the tooth 81 which coincides to the right edge, as viewed in FIG. 2, of the slot 62, is (0.314 rad). The angle formed by the line 95 and a line 96 which intersects the axis of rotation 73 and is common to the left edge, as viewed in FIG. 2, of the slot 62 which corresponds to the right edge, as viewed in FIG. 2, of the tooth 82, is 18° (0.314 rad). This relationship is maintained around the entire circumference of the chopping wheel 41 so as to provide a plurality of equally, angularly spaced openings through which the reference molecular beam and the sample molecular beam are alternately passed.

The circle 98, which will be referred to as the pitch circle, has a preferred diameter 99 of 3.196 inches (8.117 cm). The chord 101 of the pitch circle 98 is preferably 0.500 inches (1.27 cm). The chord 102 of the pitch circle 98 is preferably 0.500 inches (1.27 cm). This relationship is maintained for all of the chords of the pitch circle 98 which are defined by the edges of the slots 62–71 and the edges of the teeth 81–90.

Provision is made for moving the chopping wheel 41 into the path of the reference molecular beam and the sample molecular beam. The position of the chopping wheel 41 is adjusted so as to insure that as one molecular beam is being passed through the chopping wheel 41, the other molecular beam is being blocked by the chopping wheel 41.

The important feature of the chopping wheel 41 is the angular spacing of the slots 62–71. These slots must be equally, angularly spaced so that the chopping wheel can be aligned in such a manner that the two molecular beams, illustrated in FIG. 1, will be transmitted alternately to the mass spectrometer 18. It is noted that the chopping wheel 41 need not have a circular periphery and it is not required that the slots 62–71 have an edge which is open. The slots 62–71 could be holes cut in a plate with all of the edges of the slots 62–71 being enclosed by the plate. It is again reiterated that the important feature of the chopping wheel 41 is the presence of openings which are equally angularly spaced with respect to an axis of rotation.

The chopping wheel 41 may be moved transversely to the sample and reference beams illustrated in FIG. 1. In this manner the chopping wheel 41 can be moved so that when the disc is rotated on its axis of rotation 73 the two molecular beams will be alternately passed to the mass spectrometer 18. It is noted that the axis of rotation of the chopping wheel 41 will be parallel to the two molecular beams illustrated in FIG. 1. Again, the position of the chopping wheel 41 is adjusted in such a manner that when the first beam is being blocked by the chopping wheel 41 the second beam will be transmitted to the mass spectrometer 18.

Figure 3:
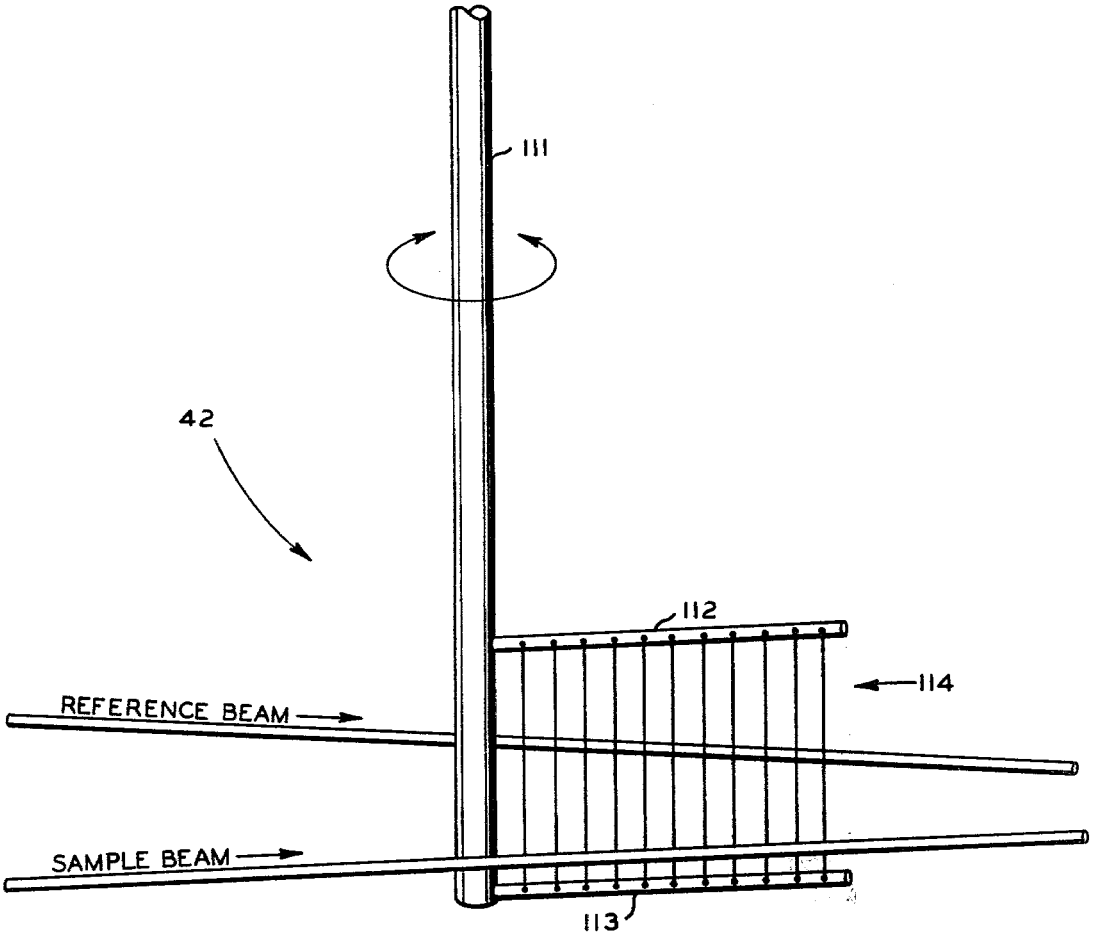
FIG. 3 is an illustration of the beam balance filter illustrated in FIG. 1.

The beam balance filter 42, illustrated in FIG. 1, is more fully illustrated in FIG. 3. The beam balance filter 42 consists of a rod 111 to which two rods 112 and 113 are attached in such a manner that each of rods 112 and 113 form a right angle with rod 111. The filter grid 114 is formed by a plurality of parallel wires which are attached to both rod 112 and rod 113.

The beam balance filter is utilized to make the intensity of the sample beam and the reference beam, as seen by the mass spectrometer, equal. To accomplish this, shaft 111 is rotated so as to place the filter grid 114 either in the reference beam or the sample beam. The filter grid 114 blocks a portion of either the reference beam or the sample beam and in this manner the intensity of the reference beam and sample beam, as seen by the mass spectrometer, may be set equal. The beam balance filter 42 is extremely useful in calibrating the system illustrated in FIG. 1 so as to allow accurate measurement of the infinite dilution activity coefficients.

Figure 4:
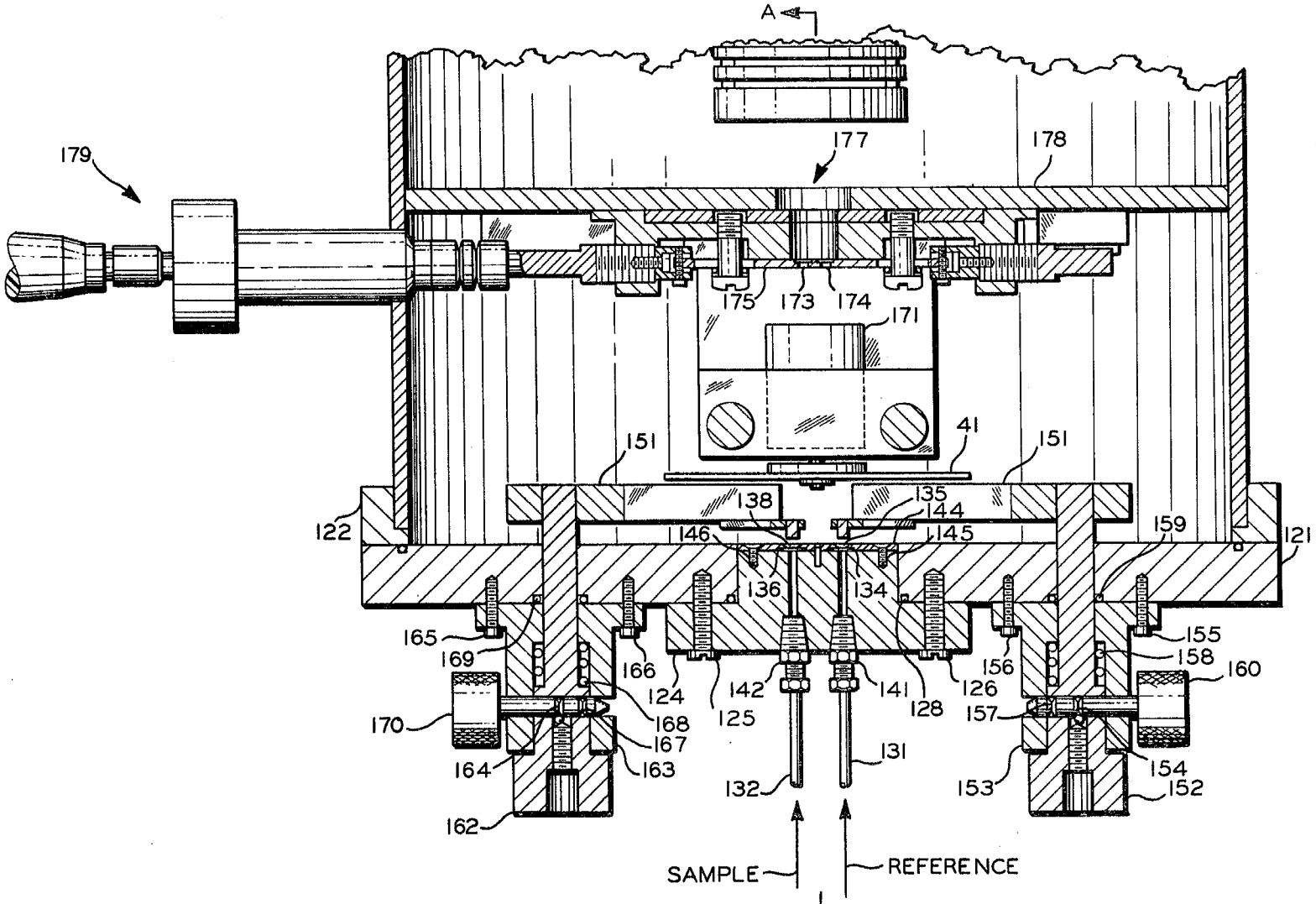
FIG. 4 is a top view in cross section of the apparatus associated with the chopping wheel illustrated in FIG. 1.
Figure 5:
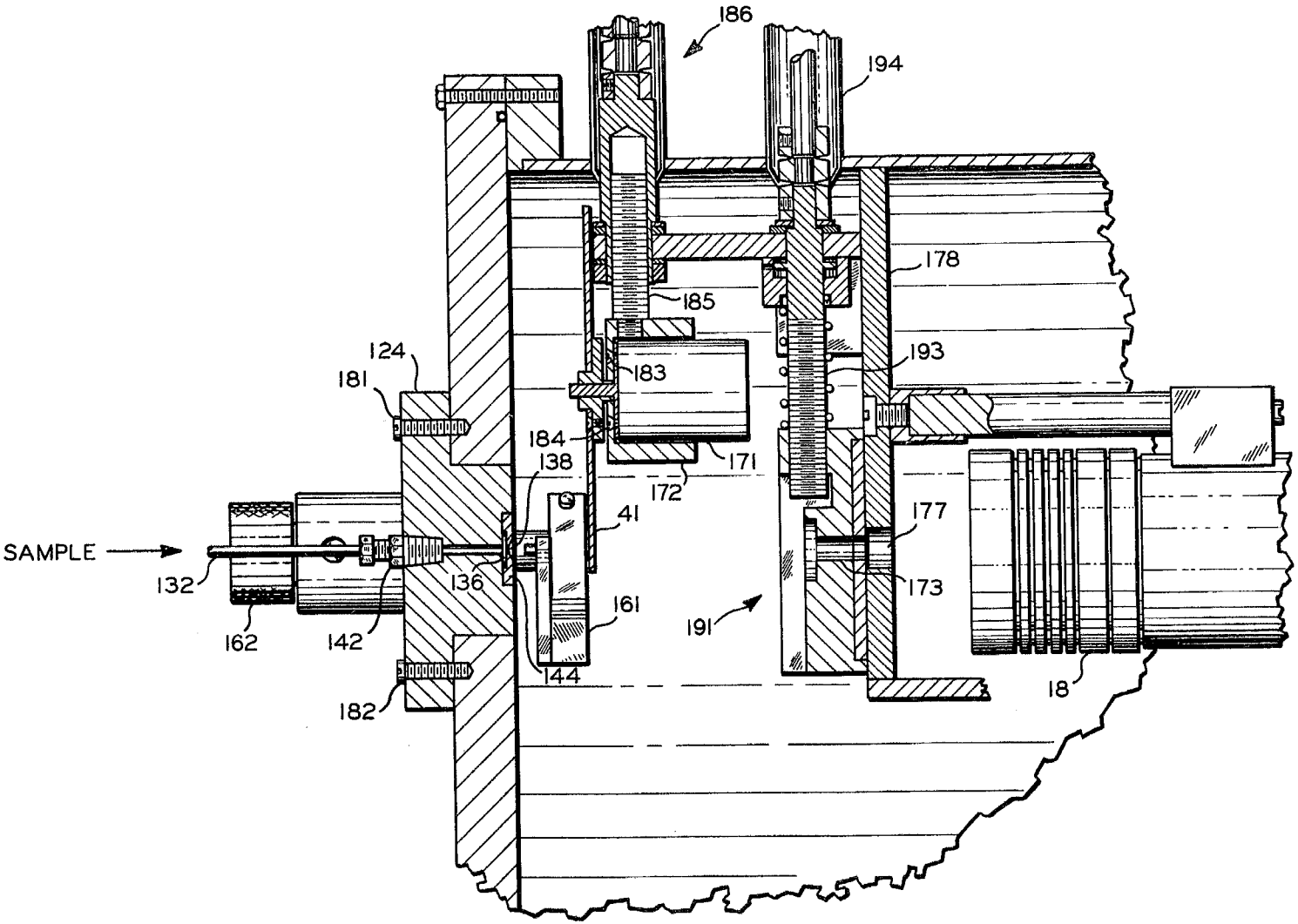
FIG. 5 is a side view in cross section of the apparatus associated with the chopping wheel illustrated in FIG. 1.

The apparatus associated with the chopping wheel 41, illustrated in FIG. 1, is illustrated in the cross-sectional views of FIGS. 4 and 5. Referring now to FIG. 4, the inlet flange 121 and the cylindrical plate 122 form the primary structural support for the chopping wheel mechanism. The plate 124 is connected to the inlet flange 121 by bolts 125 and 126. The O-ring 128 is utilized to seal the plate 124 to the inlet flange 121.

The reference molecular beam passes through conduit means 131, the Buckbee-Meer's aperture 134 and the aperture 135. The sample molecular beam passes through conduit means 132, the Buckbee-Meer's aperture 136 and the aperture 138. Conduit means 131 and 132 are operably connected to the plate 124 by couplings 141 and 142 respectively. The Buckbee-Meer's apertures 134 and 136 are held in place by the plate 144 in which the apertures 135 and 138 are formed. The plate 144 is connected to the plate 124 by screws 145 and 146.

The flag arm 151 is utilized to block the reference molecular beam if desired. The flag arm 151 is moved by rotating the flag arm control knob 152 which is operably connected to the flag arm 151. The flag arm control knob 152 is supported by the cylindrical plate 153 which is connected to the inlet flange 121 by bolts 155 and 156. A spring 158 surrounds a portion of the flag arm control knob 152 and is enclosed by the cylindrical plate 153. An O-ring 159 is utilized to seal the cylindrical plate 153 to the inlet flange 121.

The flag arm 161 is utilized to block the sample molecular beam if desired. The flag arm 161 is moved by rotating the flag arm control knob 162 which is operably connected to the flag arm 161. The flag arm control knob 162 is supported by the cylindrical plate 163 which is connected to the inlet flange 121 by bolts 165 and 166. A spring 168 surrounds a portion of the flag arm control knob 162 and is enclosed by the cylindrical plate 163. An O-ring 169 is utilized to seal the cylindrical plate 163 to the inlet flange 121.

The flag arm 151 is normally in a position which will not block the reference molecular beam. The flag arm 151 is locked in this position by the locking pin 160. When it is desired to rotate the flag arm 151 into the path of the reference molecular beam, the locking pin 160 is pulled out to a position in which the groove 157 is substantially in the position occupied by the groove 154 when the locking pin 160 is in a locked position. After the locking pin 160 is pulled out, the flag arm control knob 152 can be utilized to rotate the flag arm 151 into the path of the reference molecular beam.

The flag arm 161 is normally in a position which will not block the sample molecular beam. The flag arm 161 is locked in this position by the locking pin 170. When it is desired to rotate the flag arm 161 into the path of the sample molecular beam, the locking pin 170 is pulled out to a position in which the groove 167 is substantially in the position occupied by the groove 164 when the locking pin 170 is in a locked position. After the locking pin 170 is pulled out, the flag arm control knob 162 can be utilized to rotate the flag arm 161 into the path of the sample molecular beam.

The chopping wheel 41 is operably mounted on the drive shaft of the motor 171. The motor 171 is supported by motor bracket 172. Two guide posts 180 and 175 are utilized to position the motor bracket 172.

Two apertures 173 and 174 are located in plate 175. The reference molecular beam and the sample molecular beam pass through the apertures 174 and 173 respectively and then through the opening 177 in the rear flange 178 into the ionizer of the mass spectrometer 18, illustrated in FIG. 1. The micrometer assembly 179 may be utilized to move the apertures 173 and 174 and thus provide a horizontal adjustment for the position of the apertures 173 and 174.

Referring now to FIG. 5, the sample molecular beam passes through conduit means 132, the Buckbee-Meer's aperture 136 and the aperture 138. Conduit means 132 is operably connected to the plate 124 by coupling 142. The plate 124 is operably connected to the front flange 121 by bolts 181 and 182. The Buckbee-Meer's aperture 136 is held in place by the plate 144 in which the aperture 138 is formed.

The flag arm 161 is operably connected to the flag arm control knob 162 as is more fully shown in FIG. 4. The flag arm 161 may be rotated into or out of the path of the sample molecular beam by manipulating the flag arm control knob 162.

The chopping wheel 41 is operably connected to the drive shaft of the motor 171. The motor is supported by the support bracket 172. The motor 171 is connected to the support bracket 172 by screws 183 and 184. The support bracket 172 is connected to the chopper screw 185. The micrometer assembly 186, together with the chopper screw 185, provide for vertical adjustment of the position of the chopping wheel 41.

The sample molecular beam passes through the aperture 173 which is located in the plate assembly 191 and then passes through the opening 177 in the rear flange plate 178 into the ionizer of the mass spectrometer 18. The plate assembly 191 is operably connected to the aperture vertical adjustment screw 193. The micrometer assembly 194, in combination with the aperture vertical adjustment screw 193, provides a means for adjusting the vertical position of the aperture 173.

Referring now to both FIGS. 4 and 5, the position of the chopping wheel 41 is first adjusted in such a manner that the two molecular beams are passed alternatively to the mass spectrometer 18. This is accomplished by the operator using micrometer assembly 186. The position of the apertures 173 and 174 is adjusted horizontally by the operators using micrometer 179. The vertical position of the apertures 173 and 174 is adjusted by the operator using the micrometer assembly 194. Once these adjustments have been made, the two molecular beams may be passed alternately through the chopping wheel assembly shown in FIGS. 4 and 5 and thus into the mass spectrometer 18.

As has been previously stated, the mass spectrometer 18 illustrated in FIG. 1 is an Extranuclear Corporation Model 270-9 quadrupole mass spectrometer equipped with an axial ionizer. A complete description of the mass spectrometer may be obtained from Extranuclear Corporation. The following brief description of the mass spectrometer is provided to provide background information for the discussion of preferred modifications to the standard mass spectrometer. These modifications are described in detail hereinafter.

Figure 6:
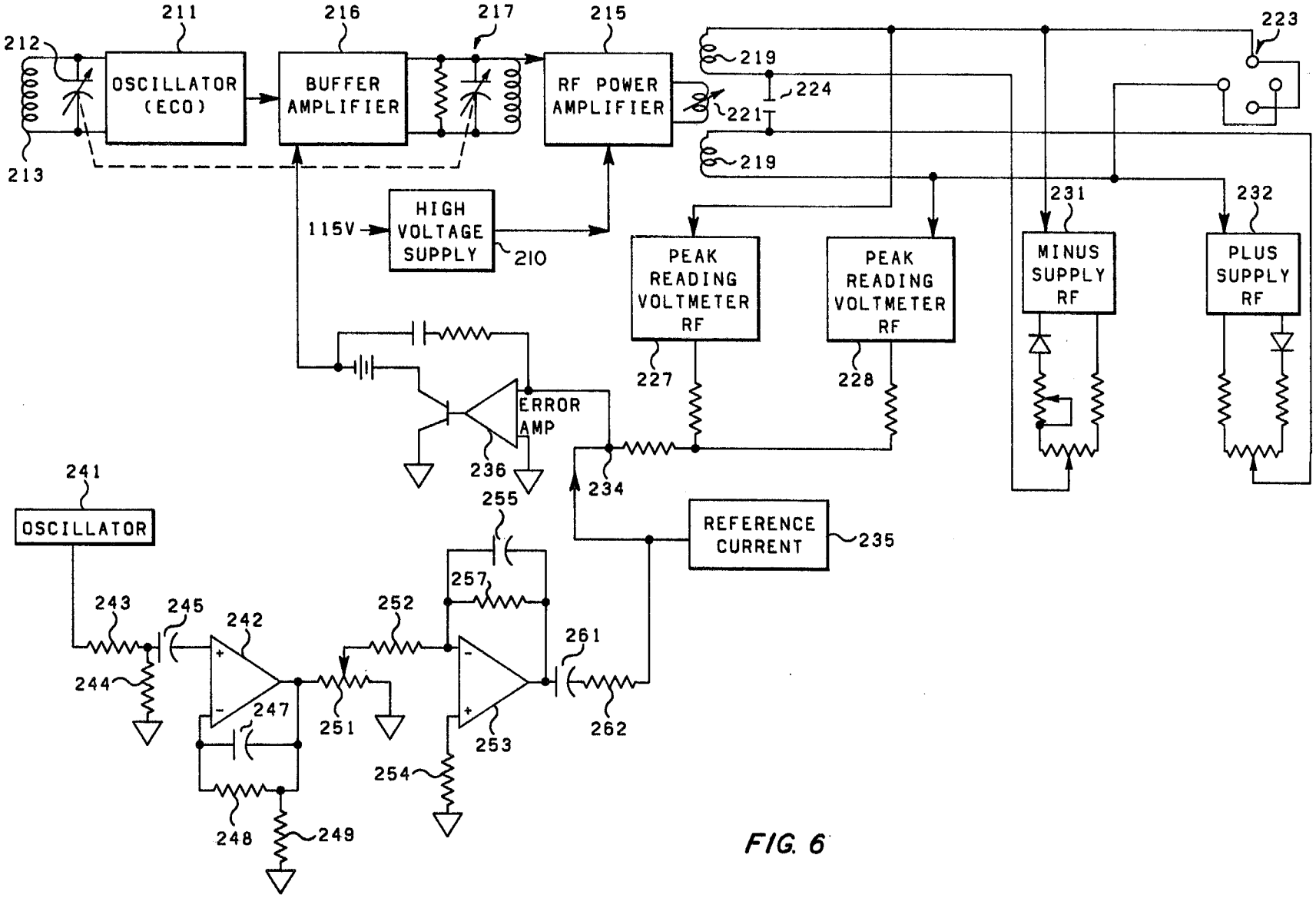
FIG. 6 is a schematic of the electrical circuitry associated with the mass filter of the mass spectrometer illustrated in FIG. 1.

Referring now to FIG. 6, the RF voltage required by the mass spectrometer is generated by the electron coupled oscillator circuit 211 in conjunction with the LC circuit made up of variable capacitor 212 and inductor 213. The amplitude of the drive signal which is provided to the RF power amplifier tube 215 is controlled by a buffer amplifier tube 216 which has a low Q resonant plate circuit 217. This resonant circuit 217 is bandswitched and tuned in conjunction with the oscillator circuit (specifically variable capacitor 212) so that the frequency output from the buffer amplifier 216 tracks that of the electron coupled oscillator 211. The output amplitude from the buffer amplifier 216 is controlled by varying the negative voltage applied to the cathode of the buffer amplifier tube (the plate and screen being at DC ground).

The RF power amplifier 215, which is preferably an 8122 high dissipation RF power amplifier tube, raises the power level of the RF signal so that peak-to-peak pole voltages of 3 to 8 KV can be obtained. Power is supplied to the RF power amplifier 215 from the high voltage supply 210.

The high RF voltage necessary to operate the quadrupole mass filter is produced by a resonant circuit. This circuit is formed by the inductor 219 and the external capacity represented by the quadrupole mass filter and cables. The RF power amplifier 215 is coupled to the resonant circuit through a variable coil 221 which is mounted in the center of the inductor 219. The variability of the coupling assures a proper impedance match and maximum power transfer from the RF power amplifier 216 to the electrodes 223 of the mass filter. The inductor 219 is split at the center so that DC pole potentials may be connected at a point of low RF potential while RF continuity at this split is maintained by the capacitor 224. Two peak reading vacuum diode RF voltmeters 227 and 228 are connected to the output terminals of the inductor 219. The DC voltages produced by the two voltmeters 227 and 228 are averaged and used to regulate and meter the RF voltage applied to the electrodes 223. This DC control voltage is proportional to the mass to which the quadrupole mass filter is tuned. The difference between the two voltages produced by the RF voltmeters 227 and 228 represents the RF voltage unbalanced between the poles of the mass filter.

The RF voltage appearing at the high side of the inductor 219 is supplied to the minus supply 231. This RF voltage is rectified to give a DC voltage which is applied back through the inductance 219 to two of the electrodes 223 of the mass filter associated with the mass spectrometer. In like manner, the RF voltage from the low side of the inductor 219 is supplied to the plus supply 232. This RF voltage is rectified to give a DC voltage which is applied back through the inductor 219 to two of the electrodes 223 of the mass filter.

The level of the RF and DC voltages applied to the electrodes 223 of the mass filter is a function of the DC currents which are summed at the summing junction 234. Prior to the modification, which is preferred in the present invention, the normal summation of currents at the summing junction 234, including a stabilized reference current which is supplied from the reference current source 235 and which is operator set, produces a zero voltage at the summing junction 234 with respect to the system ground. Any deviation from such zero voltage affects a negative feedback through the error amplifier 236 to the buffer amplifier 216. The buffer amplifier varies the RF output to the RF power amplifier 215 in such a manner as to drive the voltage at the summing junction 234 to a zero level. Since the DC voltages applied to opposite poles of the mass filter are derived from the RF voltages applied to the opposite poles of the mass filter, it follows that any variation in applied RF voltages will affect the DC voltages applied to the electrodes of the mass filter.

The present preferred modification provides the addition of a small AC current to the summing junction 234. This AC current affects a small amplitude variation in the normal RF and DC voltages applied to the electrode of the mass filter. In this manner, mass selection by the mass filter is caused to vary at the frequency of the AC current applied to the summing junction 234. A mass scanning effect is thus provided which tends to substantially eliminate unbalances caused by the fact that the two molecular beams are entering the ionizer from different directions and are thus ionized in different regions. The manner in which this AC current is generated and supplied to the summing junction 234 is described hereinafter.

The oscillator 241 provides a well regulated (both amplitude and duty cycle) 5-volt square wave. The output from the oscillator 241 is tied to the noninverting input of the operational amplifier 242 through resistors 243 and 244 and capacitor 245. Resistors 243 and 244 act as a voltage divider which preferably attenuates the output from the oscillator 241 by a factor of 10. The capacitor 245 serves to isolate the operational amplifier 242 from any DC voltage offset which may be provided from the output of the oscillator 241.

The output from the operational amplifier 242 is fed back to the inverting input of the operational amplifier 242 through capacitor 247, resistor 248 and resistor 249. The gain of the operational amplifier 242 is determined by the relationship of resistor 248 and resistor 249. This gain is preferably 20. The capacitor 247 limits the high frequency gain of the operational amplifier 242.

The output of the operational amplifier 242 is tied to the potentiometer 251. The wiper arm of the potentiometer 251 is tied through resistor 252 to the inverting input of operational amplifier 253. The noninverting input of operational amplifier 253 is tied to ground through resistor 254. The output of the operational amplifier 253 is fed back to the inverting input of the operational amplifier 253 through the parallel combination of capacitor 255 and resistor 257. The operational amplifier 253 and its associated circuitry acts as an integrating circuit. The voltage applied to the noninverting input of the operational amplifier 253 is controlled by the setting of the potentiometer 251. The square-wave input to the operational amplifier 253 is operated on by the integrating circuit so as to provide a triangular waveform at the output of the operational amplifier 253. The manner in which this is accomplished is fully described in Philbrick Researchers, Inc., Applications Manual For Computing Amplifiers, 1966, George A. Philbrick Researchers, Inc., Second Edition.

The output triangular wave from the operational amplifier 253 is provided through capacitor 261 and resistor 262 to the summing junction 234. The capacitor 261 serves to isolate any DC offset voltage originating within either operational amplifier 242 or operational amplifier 253 from the summing junction 234. The resistor 262 serves to limit the current provided to the summing junction 234 to approximately 0.4 milliamps. Thus, a triangular waveform is provided to the summing junction 234 which provides the desired modulation of the DC voltage applied to the electrodes 223 of the mass filter.

It is desirable that the triangular waveform provided as an output from the operational amplifier 253 be extremely stable. For this purpose, a regulated power supply is utilized to supply power to the oscillator 241 which is preferably a 504-V manufactured by RCA.

The following examples are presented to further illustrate the present invention.

The following procedure was utilized in measuring the infinite dilution activity coefficients for a number of solutions. The equilibrium cells 16 and 17 were prepared for loading by cleaning with a solvent, then drying and evacuating. The solvent used must not interfere mass spectrally with the solutions to be studied. If possible, it is preferable to use the solvent of the mixture being studied for rinsing the equilibrium cells 16 and 17. After evacuation, the equilibrium cells 16 and 17 are both loaded with six milliliters of pure solvent. The equilibrium cells 16 and 17 are then sealed and the molecular beam system illustrated in FIG. 1 is evacuated.

Once a desired vacuum has been reached, the molecular beams are passed through the chopping wheel assembly 41 and thus into the mass spectrometer 18. The electronic signal produced in the mass spectrometer are then compared. The intensities of the two molecular beams are adjusted by moving the beam balance filter 42 into one beam until the intensity of both molecular beams are equal to 1 part in 1000 to 10,000.

Measurements require that a small amount of solute be injected into the equilibrium cell 16. The presence of the solute causes the vapor pressure of the mixture to differ from that of the pure solvent. It is this change in pressure following the concentration change that is utilized to determine $\gamma\infty$. To measure the change, the molecular beam intensities are compared as has been previously described. Changes as small as 1 part in 1000 are easily determined. This measurement is made for each specie in the mixture. As a calibration, the intensity of the pure beam is also measured at this time. From the known vapor pressure of the species in the mixture and the pure beam intensity, the absolute magnitude of the pressure change on mixing can be calculated.

As has been previously stated, two methods can be utilized to determine $\gamma\infty$. The first technique, which has been termed the partial pressure method, uses the partial pressure change for each specie and equation (10) to calculate $\gamma\infty$. The second technique, which has been termed the pressure-concentration method, uses the total pressure change, the solution concentration change and equation (3) to calculate $\gamma\infty$.

The partial pressure method seems to function only when the vapor pressures of the two components are approximately the same. Systems on which the method was applied are 1) $H_2O$ and HDO, 2) $H_2O$ and ethanol. Table I lists the experimental data for the $H_2O$ and HDO system and Table II lists the experimental data for the $H_2O$ and ethanol system.

TABLE I $\gamma^\infty$ DATA FOR HDO IN $H_2O$ AT 25C

| Test | Pressure Changes (Arbitrary Units) MASS 18 $H_2O$ | MASS 19 HDO | $-\Delta P_{19}/\Delta P_{18}$ | $\gamma^\infty HDO$ |
|---|---|---|---|---|
| 0 | 7.5 | −0.6 | | |
| 1 | −16.1 | 24.0 | 1.042 | 1.114 |
| 2 | −43.5 | 52.8 | 1.047 | 1.119 |
| 3 | −49.2 | 57.0 | 1.012 | 1.082 |
| 4 | −54.0 | 63.0 | 1.034 | 1.105 |
| 5 | −57.6 | 68.1 | 1.055 | 1.128 |
| 6 | −67.2 | 81.0 | 1.092 | 1.167 |
| 7 | −84.0 | 93.3 | 1.026 | 1.097 |
| 8 | −104.7 | 115.2 | 1.026 | 1.097 |
| 9 | −121.2 | 134.4 | 1.049 | 1.121 |

TABLE II $\gamma^\infty$ DATA FOR THE ETHANOL-WATER SYSTEM

| Experiment | Temp (°C.) | $\Delta P_{18}$ $H_2O$ | $\Delta P_{31}$ Ethanol | $-\Delta P_{18}/\Delta P_{31}$ | $\gamma^\infty$ |
|---|---|---|---|---|---|
| Water in Ethanol | 25 | +5.5 | −5.0 | 1.1 | 2.62 |
| Water in Ethanol | 25 | 5.0 | −7.0 | 1.4 | 3.34 |
| Water in Ethanol | 25 | 6.0 | −9.0 | 1.5 | 3.57 |
| Water in Ethanol | 25 | 6.0 | −9.0 | 1.5 | 3.57 |
| Ethanol in Water | 10 | −7.65 | 58.6 | 0.131 | 3.16 |
| Ethanol in Water | 10 | −1.93 | 14.89 | 0.130 | 3.18 |
| Ethanol in Water | 10 | −2.57 | 19.88 | 0.129 | 3.20 |

The pressure concentration method seems to be the most versatile since it can eliminate the effect of a large uncertainty in a relatively small partial pressure change. In the partial pressure method such an uncertainty would determine the uncertainty of the whole calculation. Systems on which the pressure-concentration method were applied are:

(1) Benzene in 1-butanol;
(2) Benzene in ethanol;
(3) n-Hexane in ethanol;
(4) Methanol in water;
(5) Water in methanol.

Tables III–VII list the results of the experiments listed above.

TABLE III

BENZENE IN 1-BUTANOL $\gamma^\infty$ DATA AT 25C

| Exp | X Benzene | SIGNAL* (MV. MM) 1-Butanol Vapor Press | 1-Butanol Diff | Benzene Diff | ΔP Torr | $\gamma^\infty$ |
|---|---|---|---|---|---|---|
| 0 | 0.00 | 1230 | 3 | 0 | 0.0 | — |
| 1 | 0.001576 | 1020 | 39 | 113 | 0.381 | 2.61 |
| 2 | 0.003054 | 1005 | 38 | 225 | 0.769 | 2.71 |
| 3 | 0.004441 | 975 | 30 | 319.5 | 1.126 | 2.73 |
| 4 | 0.005748 | 960 | 30 | 390 | 1.395 | 2.61 |
| 5 | 0.006980 | 930 | 28 | 480 | 1.773 | 2.74 |

*Mass Spectrometer relative sensitivity Benzene to 1-Butanol = 1.88

TABLE IV

BENZENE IN ETHANOL $\gamma^\infty$ DATA AT 25C

| Exp | X Benzene | Ethanol Vapor Press | Signal* (mv.mm) Ethanol Diff | Benzene Diff | ΔP Torr | $\gamma^\infty$ |
|---|---|---|---|---|---|---|
| 0 | 0.00 | 1005 | 2 | 0 | — | |
| 1 | 0.00101 | 930 | 0 | 8.5 | .489 | 5.71 |
| 2 | 0.00101 | 930 | −0 | 7.8 | .449 | 5.27 |
| 3 | 0.00196 | 930 | −2 | 11.25 | .650 | 4.11 |
| 4 | 0.00284 | 920 | 1 | 16.5 | .964 | 4.19 |
| 5 | 0.00369 | 900 | 1 | 20.0 | 1.197 | 4.03 |
| 6 | 0.00448 | 880 | 3 | 25. | 1.529 | 4.21 |
| | | | | | | 4.25 |

TABLE IV-continued

BENZENE IN ETHANOL $\gamma^{\infty}$ DATA AT 25C

| Exp | X Benzene | Ethanol Vapor Press | Signal* Ethanol Diff | (mv.mm) Benzene Diff | ΔP Torr | $\gamma^{\infty}$ |
|---|---|---|---|---|---|---|
| 7 | 0.00 | 895 | 5.5 | 1.5 | — | — |
| 8 | 0.00101 | 845 | 6.0 | 9.1 | 0.501 | 5.83 |
| 9 | 0.00196 | 840 | 4.0 | 11.4 | 0.658 | 4.15 |
| 10 | 0.00284 | 835 | 5.0 | 15.6 | 0.942 | 4.11 |
| 11 | 0.00369 | 825 | 5.0 | 20.25 | 1.269 | 4.23 |
| 12 | 0.00448 | 820 | 4.5 | 24.0 | 1.533 | 4.21 |
| | | | | | | 4.31 |

*Mass Spectrometer relative sensitivity Benzene to Ethanol = 1.06

TABLE V n-HEXANE IN ETHANOL $\gamma^{\infty}$ DATA AT 25C

| Exp | X n-Hexane | Signal *(mv.mm) Ethanol Vapor Press | Ethanol Diff | n-Hexane Diff | ΔP Torr | $\gamma^{\infty}$ |
|---|---|---|---|---|---|---|
| 0 | 0.00 | 1290 | −0.6 | .45 | — | |
| 1 | 0.000689 | 1221 | −0.3 | 8.7 | .557 | 5.74 |
| 2 | 0.001334 | 1170 | −1.5 | 14.7 | .981 | 5.26 |
| 3 | 0.001941 | 1140 | −2.1 | 19.8 | 1.356 | 5.02 |
| 4 | 0.002541 | 1110 | −3.6 | 23.25 | 1.636 | 4.65 |
| 5 | 0.003055 | 1110 | −3.0 | 26.4 | 1.858 | 4.41 |
| 0 | 0.00 | 1080 | — | — | — | — |
| 1 | 0.000689 | 1050 | −2.4 | 8.1 | 0.602 | 6.18 |
| 2 | 0.001334 | 1065 | −5.1 | 12.5 | 0.917 | 4.94 |
| 3 | 0.001941 | 1044 | −6.6 | 17.85 | 1.33 | 4.95 |
| 4 | 0.002541 | 1050 | −7.8 | 22.05 | 1.64 | 4.66 |
| 5 | 0.003055 | 1041 | −9.0 | 24.45 | 1.835 | 4.37 |
| 0 | 0.00 | 990 | 0.0 | 0.0 | | |
| 1 | 0.000689 | 975 | 0.3 | 6.15 | 0.492 | 5.11 |
| 2 | 0.001334 | 930 | 0.0 | 12.0 | 1.007 | 5.38 |
| 3 | 0.001941 | 930 | −2.4 | 14.4 | 1.209 | 4.51 |
| 4 | 0.002541 | 915 | −3.6 | 18.3 | 1.526 | 4.46 |
| 5 | 0.003055 | 900 | −4.8 | 19.2 | 1.675 | 4.02 |

*Mass Spectrometer relative sensitivity n-Hexane to Ethanol = 1.32

TABLE VI

METHANOL IN WATER $\gamma^{\infty}$ DATA AT 25C

| Exp | X Methanol | Signal (mv.mm) Water Vapor Press | Water Diff | Methanol Diff | ΔP Torr | $\gamma^{\infty}$ |
|---|---|---|---|---|---|---|
| 0 | 0.00 | 6400 | 10.0 | 0.0 | — | |
| 1 | 0.000688 | 5700 | 40.0 | 16.0 | 0.252 | |
| 2 | 0.001334 | 5500 | 30.0 | 48.0 | 0.784 | |
| 3 | 0.001943 | 5400 | 15.0 | 71.0 | 1.181 | |
| 4 | 0.002516 | 5400 | −5.0 | 90.0 | 1.497 | |
| 5 | 0.003057 | 5600 | −20.0 | 132.0 | 2.117 | 6.11 |
| 0. | 0.00 | 8900 | — | 0.0 | — | |
| 1 | 0.000688 | 9200 | −120 | 35.0 | 0.342 | |
| 2 | 0.001334 | 8300 | −150 | 64.0 | 0.693 | |
| 3 | 0.001943 | 7400 | −75 | 90.0 | 1.092 | |
| 4 | 0.002516 | 7400 | −120 | 120.0 | 1.456 | |
| 5 | 0.003057 | 6500 | — | 118.5 | 1.637 | 5.33 |
| 0 | 0.00 | 6050 | 7.0 | 0.5 | — | |
| 1 | 0.000688 | 5000 | 110 | 20.0 | 0.359 | |
| 2 | 0.001334 | 4950 | 95 | 47. | 0.853 | |
| 3 | 0.001943 | 5000 | 96 | 86. | 1.54 | |
| 4 | 0.002516 | 5300 | 85 | 101 | 1.711 | |
| 5 | 0.003057 | 4900 | 80 | 114 | 2.090 | 6.07 |
| 0 | 0.00 | 7300 | 0 | 0 | — | |
| 1 | 0.000688 | 6300 | 40 | 29 | 0.413 | |
| 2 | 0.001334 | 6200 | −60 | 96 | 1.391 | |
| 3 | 0.001943 | 5900 | −36 | 97 | 1.477 | |
| 4 | 0.002516 | 5500 | −17 | 118 | 1.927 | |
| 5 | 0.003057 | 5550 | −80 | 157.5 | 2.549 | 6.20 |

The data for water and methanol have possible errors and therefore should be verified before using. A malfunction in the temperature control for the system was not recognized until the data had been collected.

TABLE VII

WATER IN METHANOL $\gamma^{\infty}$ DATA AT 25C

| Exp | X Water | Signal (mv.mm) Methanol Vapor Press | Methanol Diff | Water Diff | ΔP Torr | $\gamma^{\infty}$ |
|---|---|---|---|---|---|---|
| 0 | 0.00 | 1245 | 8.0 | 0.0 | — | — |
| 1 | 0.0181 | 1935 | −65 | −4 | −4.79 | |
| 2 | 0.0353 | 1980 | −70 | −2 | −5.00 | |
| 3 | 0.0517 | 1980 | −98 | 10 | −6.79 | |
| 4 | 0.0672 | 1740 | −75 | 2 | −6.05 | |
| 5 | 0.0820 | 1620 | −78 | 0 | −6.73 | |
| 6 | 0.0961 | 1620 | −86 | 5 | −7.36 | |
| 7 | 0.1096 | 1560 | −85 | 3 | −7.56 | 3.96 |
| 0 | 0.00 | 1365 | 0 | 0 | — | |
| 1 | 0.0181 | 1500 | −10 | −3 | −0.85 | |
| 2 | 0.0353 | 1650 | −45 | −10 | −3.46 | |
| 3 | 0.0517 | 1605 | −39 | −12 | −3.08 | |
| 4 | 0.0672 | 1470 | −25 | −4 | −2.16 | |
| 5 | 0.0820 | 1440 | −25 | 0 | −2.20 | 4.33 |
| 0 | 0.00 | 1440 | 0 | 0 | — | |
| 1 | 0.0181 | 1305 | 1 | 3 | 0.0972 | |
| 2 | 0.0353 | 1200 | 1 | −2 | 0.1057 | |
| 3 | 0.0517 | 1170 | −1 | −5 | −0.1085 | |
| 4 | 0.0672 | 1185 | −3 | 6 | −0.3212 | |
| 5 | 0.0820 | 1185 | −10 | 5 | −1.071 | |
| 6 | 0.0961 | 1155 | −13 | 7 | −1.428 | |
| 7 | 0.1096 | 1140 | −17 | 5 | −1.892 | |
| 8 | 0.1225 | 1125 | −22.5 | 2.5 | −2.538 | 4.24 |
| 0 | 0.00 | 3500 | 0 | 0 | — | |
| 1 | 0.0181 | 3150 | −15 | −6 | −0.6042 | |
| 2 | 0.0353 | 3125 | −19.5 | 0 | −0.7918 | |
| 3 | 0.0517 | 2975 | −30 | −6 | −1.280 | |
| 4 | 0.0672 | 1470 | −75 | 0 | −3.399 | |
| 5 | 0.0820 | 1440 | −67.5 | 0 | −5.95 | |
| 6 | 0.0961 | 1230 | −54 | 8 | −5.57 | |
| 7 | 0.1096 | 1140 | −54 | 12 | −6.01 | 2.44 |

The data for water and methanol have possible errors and therefore should be verified before using. A malfunction in the temperature control for the system was not recognized until the data had been collected.

Table VIII is a summary of all the $\gamma\infty$ measurements giving literature values where possible for comparison.

TABLE VIII $\gamma^{\infty}$ VALUES

| System | Temp (C) | $\gamma^{\infty}$ Value Molecular Beam | Literature |
|---|---|---|---|
| HDO in Water | 25 | 1.043 | |
| Ethanol in Water | 10 | 3.18 | 3.85–7.11 |
| Water in Ethanol | 25 | 3.28 | 2.73–3.26 |
| Benzene in 1-Butanol | 25 | 2.68 | 2.84 |
| Benzene in Ethanol | 25 | 4.28 | 4.45, 6.0 |
| n-Hexane in Ethanol | 25 | 5.67 | 9.05, 12 |
| Methanol in Water | 25 | 5.92 | 2.74, 2.23 |
| Water in Methanol | 25 | 4.18 | 1.39, 1.59 |
| Methanol in Water | 53 | 1.69 | 1.66, 2.26 |
| Water in Methanol | 50 | 3.26 | 2.20, 1.64 |

The data for water and methanol have possible errors and therefore should be verified before using. A malfunction in the temperature control for the system was not recognized until the data had been collected.

As can be seen from Table VIII, the present invention provides accurate results when compared to the literature references except for the water and methanol system in which an error occurred in the temperature control for the system. The molecular beam technique is much more versatile than the two most widely used methods, vapor-liquid equilibria compositions and gas-liquid chromatography. The molecular beam technique is also much faster than these prior art methods. As a routine procedure, the molecular beam technique is about 10 to 30 times faster than the composition measurement. The molecular beam technique has a data production efficiency close to that of the chromatographic method. It is more versatile than the chromatographic method because it can determine $\gamma_\infty$ for both components in the mixture. In addition, measurements at different temperatures can be accomplished more quickly with the molecular beam system.

While the invention has been described in terms of the presently preferred embodiment, reasonable variations and modifications are possible by those skilled in the art within the scope of the described invention and the appended claims.

That which is claimed is:

1. A method for determining infinite dilution activity coefficients comprising the steps of:

forming a first molecular beam from the vapor associated with a solution containing a solvent and a solute infinitely dilute in said solvent;

forming a second molecular beam from the vapor associated with said solvent;

passing said first molecular beam and said second molecular beam alternately to the inlet of a mass spectrometer means, said mass spectrometer means providing a first output signal which is representative of the difference in the pressure of said solute in said first molecular beam and the pressure of said solute in said second molecular beam ($\Delta P_1$) when said mass spectrometer means is set to the mass of said solute, said mass spectrometer means providing a second output signal which is representative of the difference in the pressure of said solvent in said first molecular beam and the pressure of said solvent in said second molecular beam ($\Delta P_2$) when said mass spectrometer means is set to the mass of said solvent; and establishing the infinite dilution activity coefficient for said solute in response to said first output signal and said second output signal.

2. A method in accordance with claim 1 wherein said step of establishing the infinite dilution activity coefficient for said solute in response to said first output signal and said second output signal comprises:

dividing said first output signal by said second output signal to establish a third signal representative of $\Delta P_1/\Delta P_2$;

dividing the vapor pressure of said solvent ($P_2^s$) by the vapor pressure of said solute ($P_1^s$) to establish a fourth signal representative of $P_2^s/P_1^s$; and multiplying said third signal by said fourth signal to establish the infinite dilution activity coefficient for said solute.

3. A method for determining infinite dilution activity coefficients comprising the steps of:

forming a first molecular beam from the vapor associated with a solution containing a solvent and a solute infinitely dilute in said solvent;

forming a second molecular beam from the vapor associated with said solvent;

passing said first molecular beam and said second molecular beam alternately to the inlet of a mass spectrometer means, said mass spectrometer means providing an output signal which is representative of the difference in the total pressure of said first molecular beam and the total pressure of said second molecular beam; and establishing the infinite dilution activity coefficient for said solute in response to said output signal.

4. A method in accordance with claim 3 wherein said step of establishing the infinite dilution activity coefficient for said solute in response to said output signal comprises:

dividing said output signal by the concentration of said solute in said solvent ($dx_1$) to establish a first signal representative of $(dP/dx_1)\gamma$;

summing said first signal with the vapor pressure of said solvent ($P_2^s$) to establish a second signal representative of $P_2^s+(dP/dx_1)_\infty$; and dividing said second signal by the vapor pressure of said solute ($P_1^s$) to establish the infinite dilution activity coefficient for said solute.

* * * * *

UNITED STATES PATENT AND TRADEMARK OFFICE

CERTIFICATE OF CORRECTION

PATENT NO. : 4,214,158

DATED : July 22, 1980

INVENTOR(S) : Thomas W. Schmidt

It is certified that error appears in the above-identified patent and that said Letters Patent are hereby corrected as shown below:

Column 16, claim 4, line 42, after "$(dP/dx_1)$", "$\gamma$" should be --- $\infty$ ---.

Signed and Sealed this

*Fourth* Day of *August 1981*

[SEAL]

*Attest:*

GERALD J. MOSSINGHOFF

*Attesting Officer*

*Commissioner of Patents and Trademarks*